US008353548B2

(12) United States Patent
Epstein et al.

(10) Patent No.: US 8,353,548 B2
(45) Date of Patent: Jan. 15, 2013

(54) VEHICLE COUPLING AND METHOD

(75) Inventors: Uri Epstein, Moshav Almagor (IL); Tamir Koton, Kibbutz Kholata (IL); Benny Toobie, Kibbutz Maayan Baruch (IL)

(73) Assignee: Plasan Sasa Ltd., Hagalil (IL)

( * ) Notice: Subject to any disclaimer, the term of this patent is extended or adjusted under 35 U.S.C. 154(b) by 336 days.

(21) Appl. No.: 12/490,743

(22) Filed: Jun. 24, 2009

(65) Prior Publication Data

US 2009/0322112 A1 Dec. 31, 2009

(30) Foreign Application Priority Data

Jun. 25, 2008 (IL) ..... 192447
Nov. 6, 2008 (IL) ..... 195167

(51) Int. Cl.
*B62D 24/02* (2006.01)

(52) U.S. Cl. ..... 296/35.3; 296/35.1

(58) Field of Classification Search ..... 296/35.1, 296/35.3

See application file for complete search history.

(56) References Cited

U.S. PATENT DOCUMENTS 4,783,039 A * 11/1988 Peterson et al. ..... 248/635
6,030,017 A * 2/2000 Stojkovic et al. ..... 296/35.1

* cited by examiner

*Primary Examiner* — Joseph D. Pape
(74) *Attorney, Agent, or Firm* — Oliff & Berridge, PLC

(57) ABSTRACT

A coupling between a reinforcing rib component and an underbelly component of a vehicle is provided. The coupling comprises a tooth projecting from a first of the components through a second of the components, an aperture formed in the second component and receiving therethrough the tooth, and one or more coupling elements attached to the tooth and bearing against the second component. The tooth urges the coupling elements toward the second component, thereby increasing the contact pressure between the components.

23 Claims, 8 Drawing Sheets

VEHICLE COUPLING AND METHOD

FIELD OF THE INVENTION

The present invention relates to arrangements and methods for attaching an armored cabin of a vehicle to the vehicle chassis.

BACKGROUND OF THE INVENTION

As illustrated in FIG. 1, an armored vehicle 1 may comprise a cabin 12 for housing the crew and equipment of the vehicle, and a chassis 14, which supports the cabin and other parts of the vehicle. Within the cabin is a rib 16 which extends along the width of the vehicle 1. A floor 2 of the cabin is attached to the upper part of the rib 16, and the chassis 14 is attached to downwardly projecting teeth 18 thereof which project through openings (not illustrated) in the bottom of the chassis.

SUMMARY OF THE INVENTION

According to one aspect of the present invention, there is provided a coupling between a reinforcing rib component and an underbelly component of a vehicle, the coupling comprising:

a tooth projecting from a first of the components through a second of the components;

an aperture formed in the second component and receiving therethrough the tooth; and one or more coupling elements attached to the tooth and bearing against the second component;

the tooth urging the coupling elements toward the second component, thereby increasing the contact pressure between the components.

The tooth may comprise an elongated aperture extending substantially in a direction of projection of the tooth and being configured to receive therewithin a tensioning element configured for facilitating positioning of the coupling element on the tooth.

The tensioning element may comprise a wedge having a narrow leading edge at a first end and gradually increasing in size along its length toward a second end. It may further comprise a stopper adjacent the second end thereof being configured for preventing ejection of the tensioning element through the elongated aperture in a direction toward the first end.

Each of the coupling elements may comprise a throughgoing aperture configured for facilitating securing thereof to the tooth, and a surface configured for bearing upon the second component.

The first component may be the reinforcing rib, with the second component being the underbelly.

According to another aspect of the present invention, there is provided an armored vehicle comprising a coupling as described above.

According to a further aspect of the present invention, there is provided a method for increasing the contact pressure between a reinforcing rib component and underbelly component of an armored vehicle during assembly thereof, the method comprising:

providing the components, a first of the components having a tooth projecting therefrom, and a second of the components comprising an aperture configured to receive therein the tooth;

providing one or more coupling elements configured for attachment to the tooth;

providing a tensioning element designed to facilitate attachment of the coupling elements on the tooth;

inserting the tooth through the aperture;

utilizing the tensioning element to attach the coupling elements such that the tooth urges the coupling elements toward the second component, thereby increasing the contact pressure between the components.

The tooth may comprise an elongated aperture extending substantially in a direction of projection of the tooth, the tensioning element being configured to be at least partially received therewithin.

The tensioning element may comprise a wedge having a narrow leading edge at a first end and gradually increasing in size along its length toward a second end. It may further comprise a stopper adjacent the second end thereof being configured for preventing ejection of the tensioning element through the elongated aperture in a direction toward the first end.

Each of the coupling elements may comprise a throughgoing aperture configured for facilitating securing thereof to the tooth, and a surface configured for bearing upon the second component.

The first component may be the reinforcing rib, with the second component being the underbelly.

BRIEF DESCRIPTION OF THE DRAWINGS

In order to understand the invention and to see how it may be carried out in practice, embodiments will now be described, by way of non-limiting examples only, with reference to the accompanying drawings, in which.

DETAILED DESCRIPTION OF EMBODIMENTS

Figure 1:
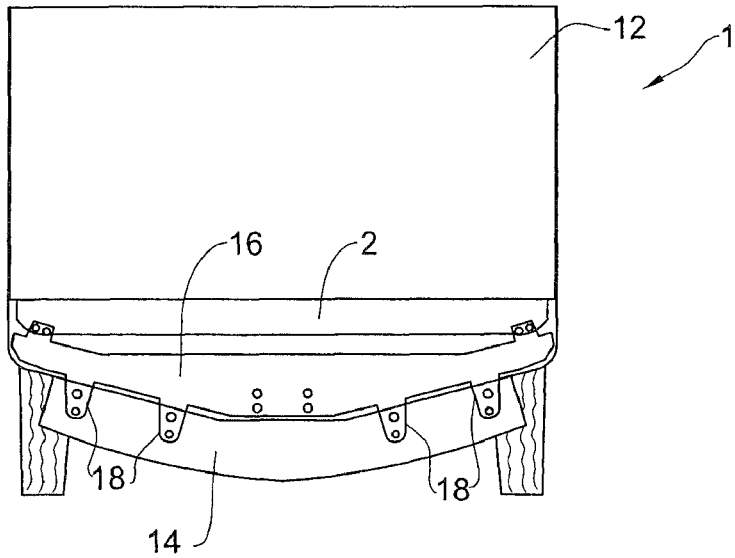
FIG. 1 is a rear partial sectional view of an armored vehicle.

As illustrated in FIGS. 2A through 4B, a coupling device 10 is provided. The coupling device 10 is adapted to mate a reinforcing rib 16 attached to (or formed integrally with) a cabin 12, which may be an armored cabin, with the portion of the chassis 14 of a vehicle upon which is rests. In addition, it is designed to increase the contact pressure between the rib 16 and an underbelly (not illustrated in FIGS. 2A through 4B) of the vehicle. Each rib 16 is provided with one or more teeth 18 projecting downwardly therefrom.

Figure 2A:
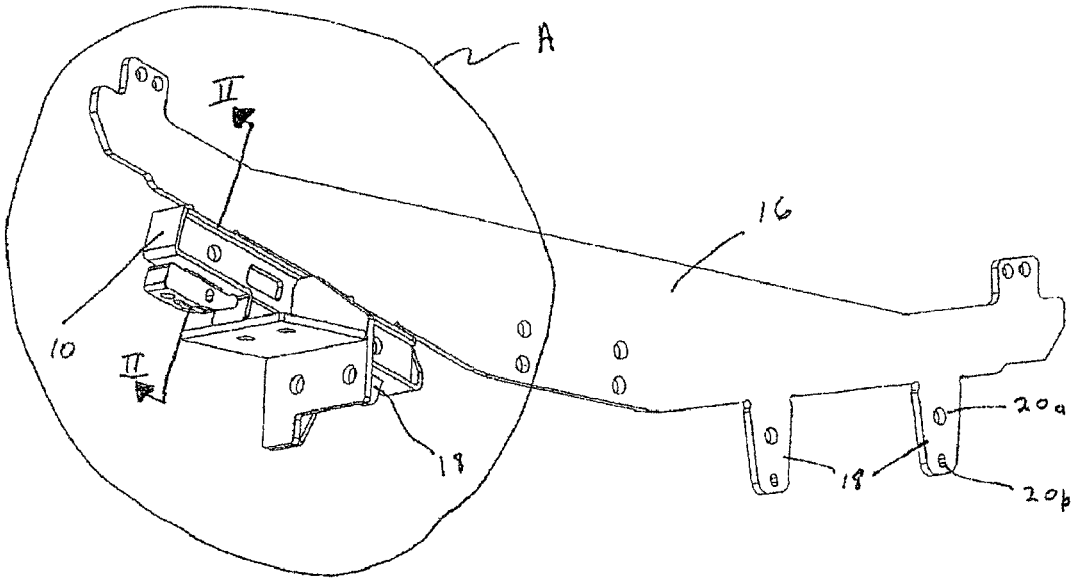
FIG. 2A is a perspective view of a rib of the vehicle illustrated in FIG. 1 with a coupling device attached thereto shown in isolation.
Figure 2B:
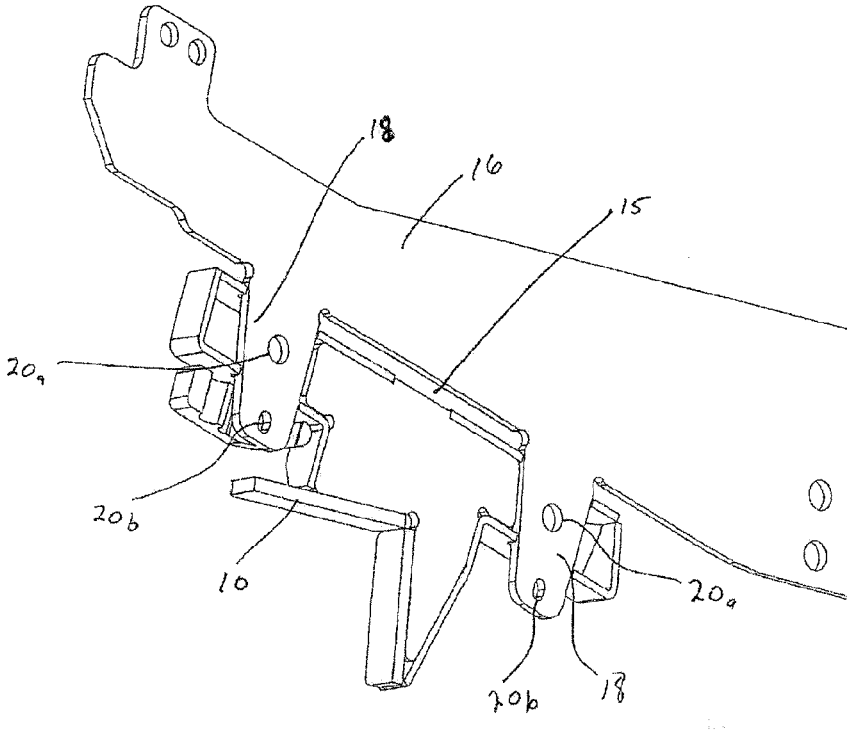
FIG. 2B is a closeup view of the area indicated at A in FIG. 2A, shown in cross-section along line II-II.

As seen in FIG. 2B, two of these teeth 18 are received within or by the coupling device 10, an example of which will be further described below. Each tooth 18 comprises a round upper aperture 20*a*, and an elongated and lower aperture 20*b*. It will be appreciated that use of the coupling device 10 as described herein does not require that all of the teeth comprise the lower aperture 20*b*, but some may only comprise the upper aperture 20*a*. When the vehicle is assembled, the underbelly of the vehicle (not illustrated in FIGS. 2A and 2B) is located in a gap 15 between the coupling device 10 and the rib 16.

Figure 3A:
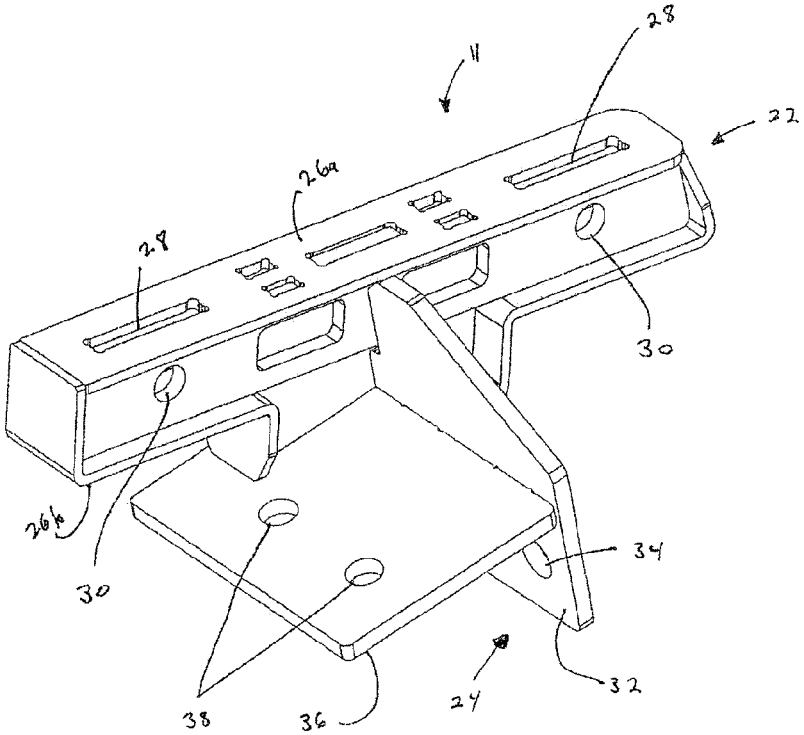
FIGS. 3A and 3B are top front and bottom rear perspective views, respectively, of the coupling device.
Figure 3B:
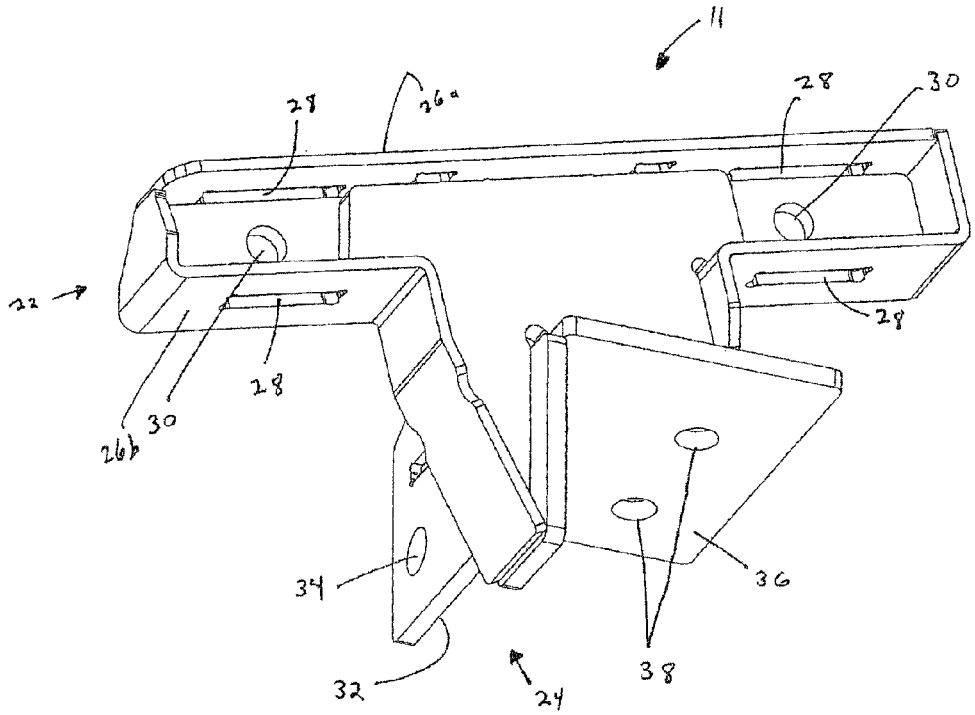

As illustrated in FIGS. 3A and 3B, the coupling device 10 comprises a coupling element 11 comprising an upper interface, generally indicated at 22, which is configured for bearing against the underbelly of the vehicle, and a chassis interface, generally indicated at 24, which is configured for attachment to a portion of the chassis 14 which lies below the underbelly, or to any other part of the vehicle.

The upper interface 22 comprises an upper surface 26*a* which may be flat, or otherwise formed so that a portion of underbelly of the vehicle may rest flatly thereupon, and a lower surface 26*b* opposite the upper surface. The upper interface 22 further comprises two slots 28, each formed so as to receive therein one of the teeth 18, beginning at the upper surface and passing downwardly therethrough. Furthermore, a through-going aperture 30 is provided adjacent each slot 28, formed substantially perpendicular to the direction which its associated slot passes. Each aperture 30 is located so as to be aligned with the upper aperture 20*a* of a tooth 18 of rib 16 when the rib is received within the slot 28.

The chassis interface 24 is designed based on the chassis to which it is to be attached. According to the example illustrated in FIGS. 3A and 3B, it comprises a first mating surface 32 which is configured for attachment to a portion of the chassis 14. The first mating surface 32 may comprise two apertures 34 for receiving therein bolts to be connected directly to the chassis, and a second mating surface 36 comprising two apertures 38 for receiving therein bolts to be connected to an angle bracket, which is secured, during installation, adjacent the chassis 14 opposite the first mating surface 32. It will be appreciated that the example of the chassis interface 24 illustrated herein is designed for attachment to a particular class of chassis, and may be modified for attachment to any other type of chassis, without deviating from the spirit and scope of the invention, mutatis mutandis.

Figure 4A:
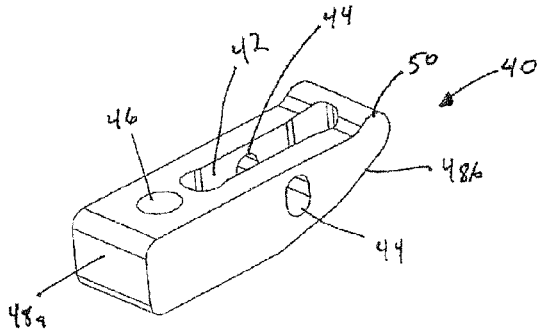
FIGS. 4A and 4B are top front and bottom rear perspective views, respectively, of a tensioning element of the coupling device.
Figure 4B:
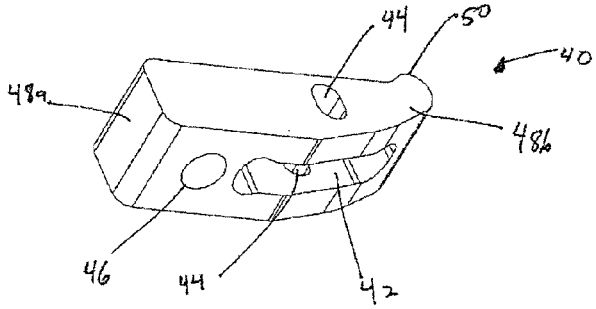

The coupling device 10 further comprises a tensioning element, 40, as illustrated in FIGS. 4A and 4B. The tensioning element 40 is formed as an elongate member. It is used during attachment of at least one of the teeth 18 of the rib 16 to the coupling device 10, in order to ensure that it fully projects from the cabin. Its relative location during attachment is illustrated, for example, in FIG. 2A.

The tensioning element 40 comprises a through-going slot 42, which is formed so as to receive therein one of the teeth 18 of the rib 16, and an elongate aperture 44 passing through the slot, which is formed so as to be aligned with the lower (elongate) aperture 20*b* of its associated tooth 18, at least during the attachment. In addition, the tensioning element 40 comprises a through-going aperture 46, which is internally threaded and located generally parallel to and on a first side 48*a* of the slot 42, and a rounded edge 50 on a second side 48*b* of the slot, which is opposite the first side. As illustrated, the rounded edge 48 may project slightly upwardly.

During installation, the cabin 12 is tightly secured to the rib 16 using the coupling device as follows. Two teeth 18 of the rib 16 which project from inside the cabin 12 through the holes formed therein are passed through the slots 28 of the upper interface 22. A bolt, or any other appropriate securing element, is passed through aperture 30 and upper aperture 20*a*. In addition, a bolt, or any other appropriate securing element, is passed through elongate apertures 44 and 20*b*. The bolt may be secured, but displacement along the lateral dimension of the apertures should be permitted. Thus, both the coupling device 10 and the tensioning element 40 are attached to the teeth 18 of the rib 16 as illustrated, e.g., in FIGS. 1 and 2A.

Subsequently, a bolt, e.g., is threaded through aperture 46 of the tensioning element, such that is advances in the direction toward the lower surface 26*b* of the upper interface 22 of the coupling element 11. As it is advanced further, it projects beyond the tensioning element 40, and bears against the lower surface 26*b* of the upper interface 22 causing the first side 48*a* of the tensioning element to move away from the lower surface of the upper interface. The tensioning element 40 thus pivots about the bolt which passes through elongate apertures 44 and 20*b*, causing the second side 48*b* of the tensioning element to move toward the lower surface 26*b* of the upper interface 22. The rounded edge 50 bears upon the lower surface 26*b* of the upper interface 22, which results in the coupling device 10 exerting a downward force on the second side 48*b* of the tensioning member 10. Thus, the tensioning element 40 pulls the tooth very tightly and securely within the slot 28, resulting in an increased contact pressure between the coupling element rib 16 and the underbelly of the vehicle. At this point, the coupling device 10 is attached securely to the tooth, for example by passing a bolt or other similar arrangement through aperture 30 and upper aperture 20*a*. The tensioning element 40 may be discarded.

The coupling device 10 is attached to the chassis 14 at this point, or before the above-described use of the coupling device 10.

By providing a coupling device 10 as above, a tight connection may be established between the rib 16 and the underbelly, without the need for welding, which may adversely affect the ballistic capability of the vehicle.

According to another example, as illustrated in FIGS. 5A through 8, a coupling device is adapted to facilitate mating of a rib with an underbelly (e.g., in the form of a deflector) of a vehicle. According to this example, a plurality of reinforcing ribs 116 is provided, having an upper surface 113, and an underbelly, comprising a central panel 117*a* and two side panel 117*b* which partially overlap one another, attached therebelow. The underbelly may comprise any number of panels, or be made as a monolithic element, without departing from the spirit and the scope of the invention. (Hereinbelow, when reference is made to the underbelly 117, it will be appreciated that reference is made to the appropriate one or more of the panels 117*a*, 117*b* according to the structure of the vehicle, mutatis mutandis. It will be further appreciated that any other appropriate portion of the vehicle may be substituted without departing from the spirit and the scope of the invention.)

Figure 6:
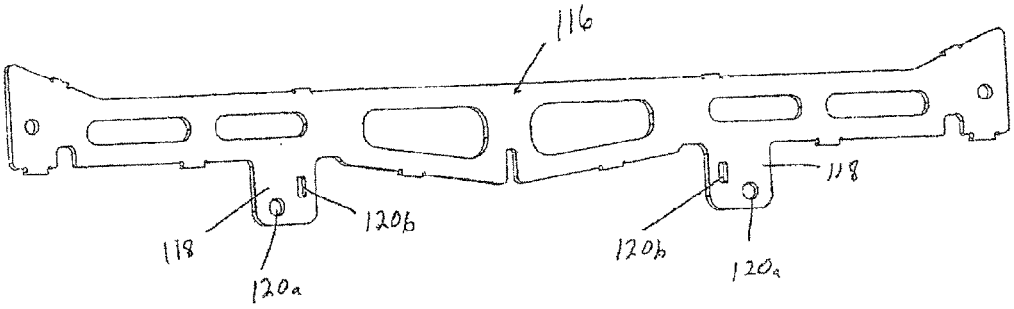
FIG. 6 is a perspective view of a reinforcing rib off the portion of the vehicle illustrated in FIGS. 5A and 5B.

As illustrated in FIG. 6, the rib 116 comprises a number of members projecting further downwardly therefrom, such as teeth 118. Each tooth 118 comprises a round aperture 120*a*, and an elongated aperture 120*b* adjacent and slightly above it. The underbelly 117 is provided with apertures or openings (not illustrated), each adapted to receive therewithin a tooth 118 projecting therethrough.

Figure 7A:
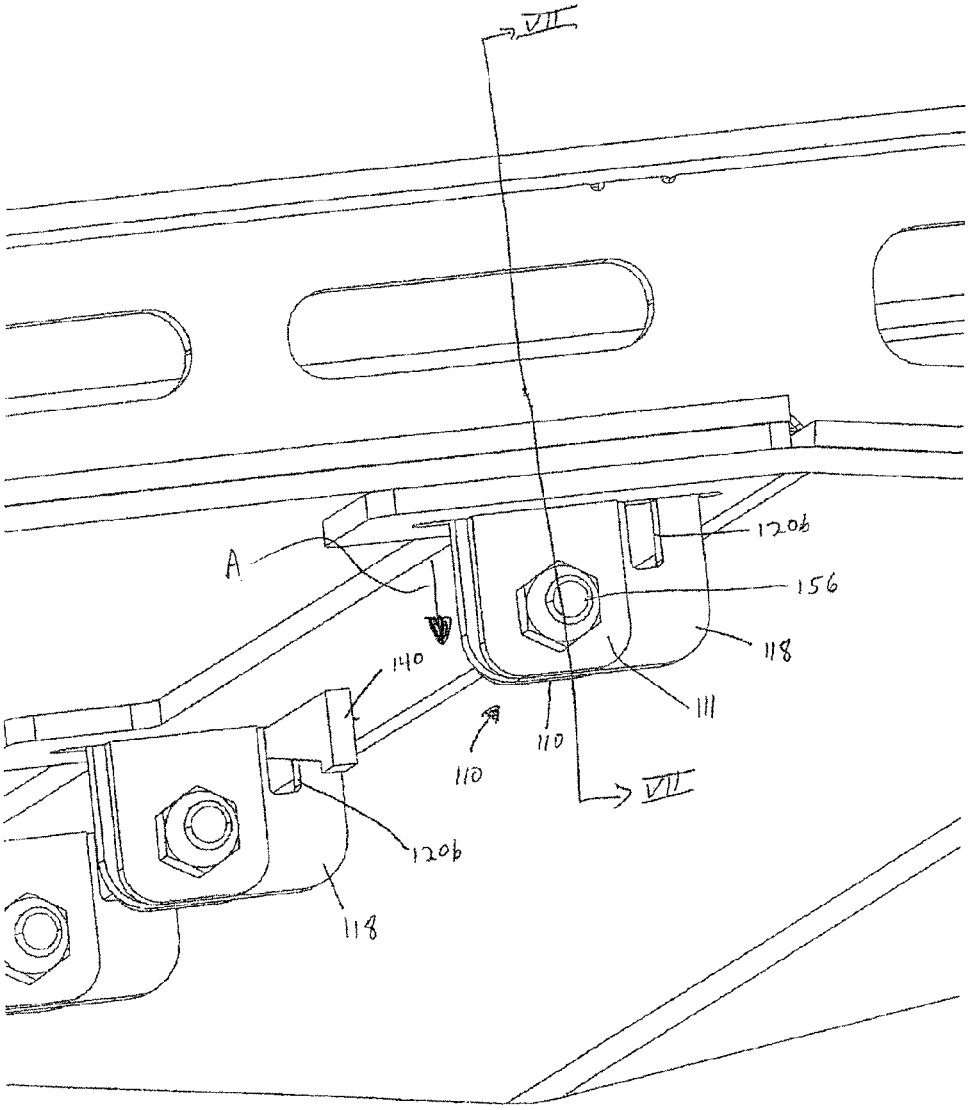
FIG. 7A is a closeup view of the area indicated at B in FIG. 5B.
Figure 7B:
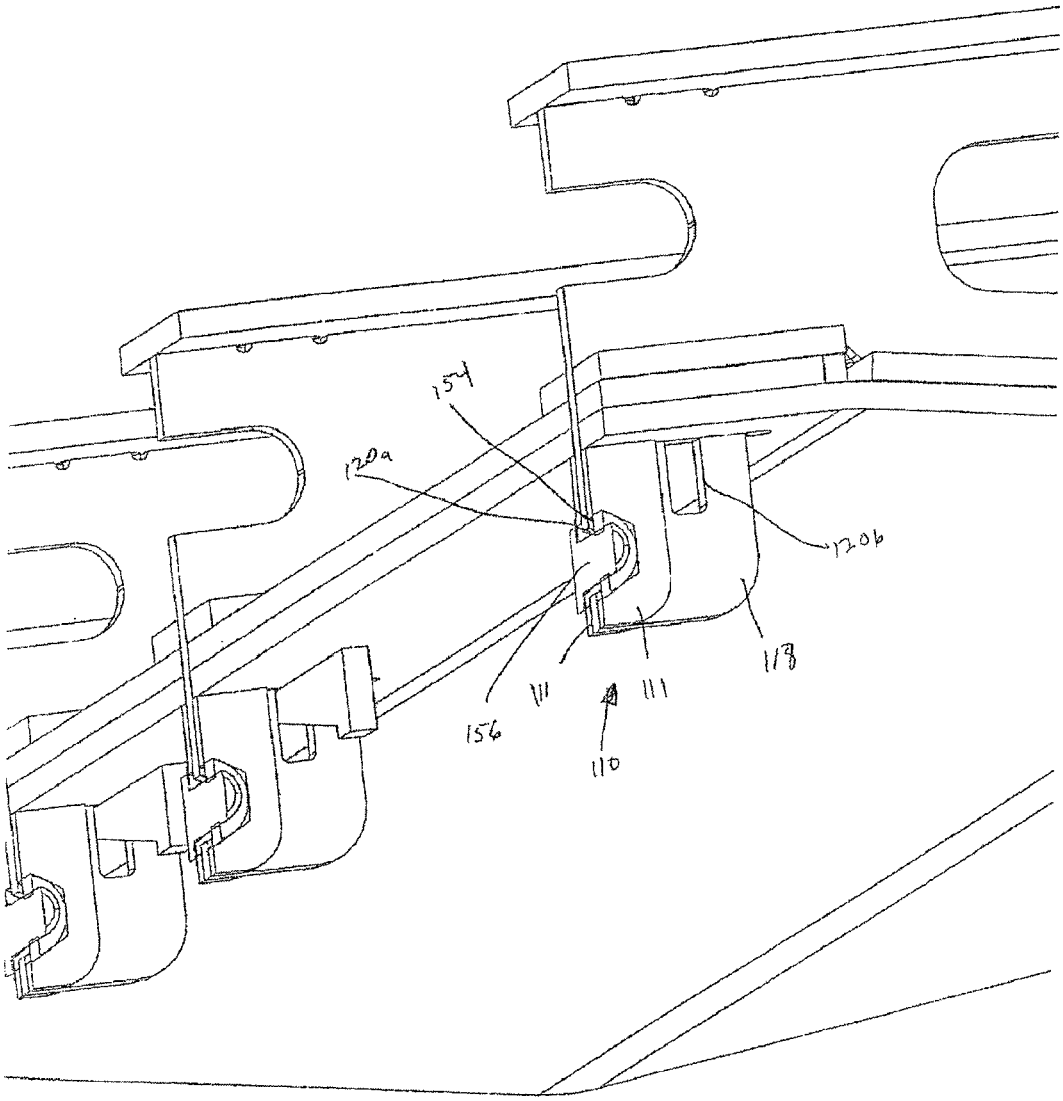
FIG. 7B is a cross-sectional view taken along line VII-VII in FIG. 7A.

As illustrated in FIGS. 7A and 7B, the coupling device 110 comprises coupling element 111 (one on either side of the tooth 118) comprising an upper surface 152, which is configured for bearing upon the underside of the underbelly 117, and a through-going aperture 154. In addition, the coupling device 110 comprises a securing mechanism 156, which may be a bolt/nut assembly, or any other similar arrangement.

Figure 8:
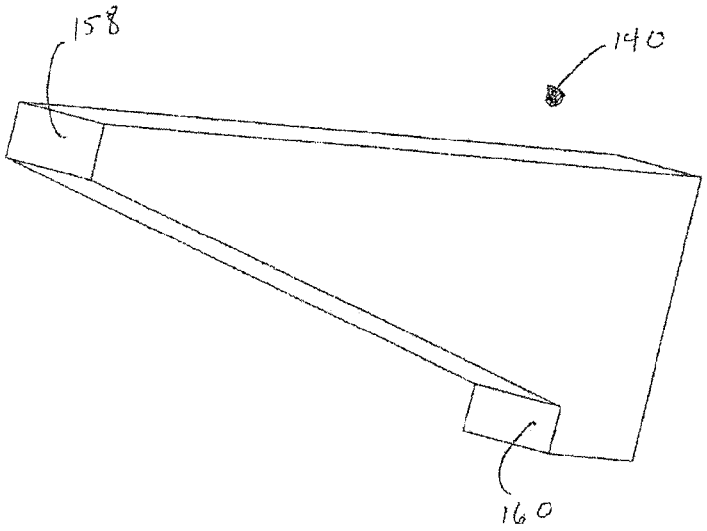
FIG. 8 is a perspective view of a tensioning element for use with the coupling device illustrated in FIGS. 5A and 5B.

The coupling device 110 further comprises a tensioning element 140, as illustrated in FIG. 8. The tensioning element 140 comprises a narrow leading edge 158, and gradually increases in size along its length. In addition, it is formed so that it can be placed within the elongated aperture 120*b*. For example, it may be formed as a wedge. In addition, the tensioning element 140 comprises a stopper 160 opposite its leading edge. The stopper is designed so that when the tensioning element 140 is inserted in the elongate aperture 120*b* as described below, it is not pushed through so far that it is ejected. Alternatively, the stopper 160 may be useful when removing the tensioning element 140; specifically, it may be useful to facilitate grabbing of the tensioning element by a tool (not illustrated). The tensioning member 140 is used during attachment of each tooth 118 of the rib 116 to the coupling device 110, in order to ensure that the tooth 118 causes the coupling element 111 bears tightly against the underbelly 117 when installed.

During installation, the tooth 118 is passed through the aperture of the underbelly 117 and projects therethrough in a direction indicated by arrow A. It will be appreciated that elongated aperture 120*b* extends in substantially the direction indicated by arrow A. The tooth 118 is designed such that when it is passed through the aperture of the underbelly 117 as above, the round aperture 120*a* clears the underbelly, and the elongated aperture 120*b* partially clears it, but clears it enough so that the leading edge 158 of the tensioning element 140 can be inserted therein. The tensioning element 140 is then placed, leading edge 158 first, within the elongated aperture 120*b* of the tooth 118, and forced in, thus pulling the tooth 118 through the aperture of the underbelly 117 as much as possible (i.e., it pulls it in the same direction that the tooth projects, as indicated by arrow A; this can be seen, e.g., in FIG. 7A). The coupling elements 111 of the coupling device are then placed so that their apertures 154 are aligned with the round aperture 120*a* of the rib, and the securing mechanism 156 is introduced and tightened/secured. If desired, the tensioning element 140 may be removed before the securing mechanism 156 is tightened/secured; in this case, the tensioning element 140 is used to pull the tooth 118 through the aperture of the underbelly 117 slightly more than necessary, in order to allow easy placement of the coupling elements 111. The coupling elements are designed such that when so secured, the tooth 118 urges them back toward the deflector so that their upper surfaces 152 bear against the lower surface of the underbelly 117, thereby increasing the contact pressure between the ribs and the underbelly.

By providing a coupling device 110 as above, a tight connection (i.e., due to increased pressure) may be established between the rib 116 and the underbelly 117 (or any other desired portions of the vehicle, mutatis mutandis), without the need for welding, which may adversely affect the ballistic capability of the cabin.

Figure 5A:
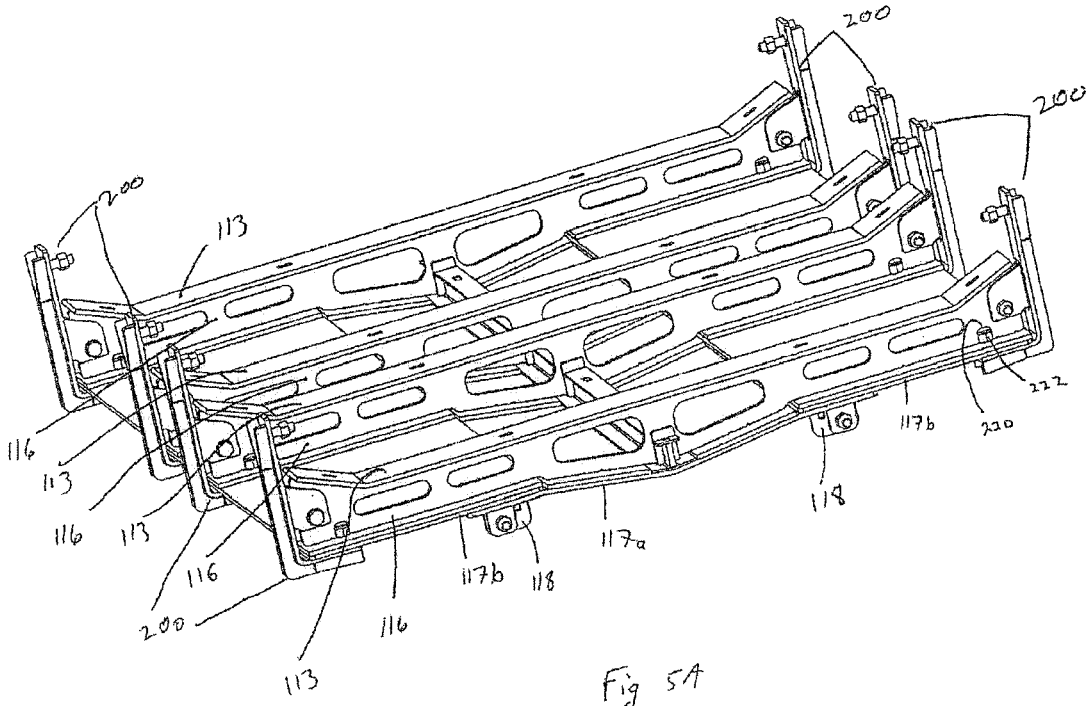
FIGS. 5A and 5B are, respectively, top and bottom perspective views of a bottom portion of the vehicle in an area wherein reinforcing ribs thereof are attached to the an underbelly thereof, showing a coupling device according to another example of the present invention.
Figure 5B:
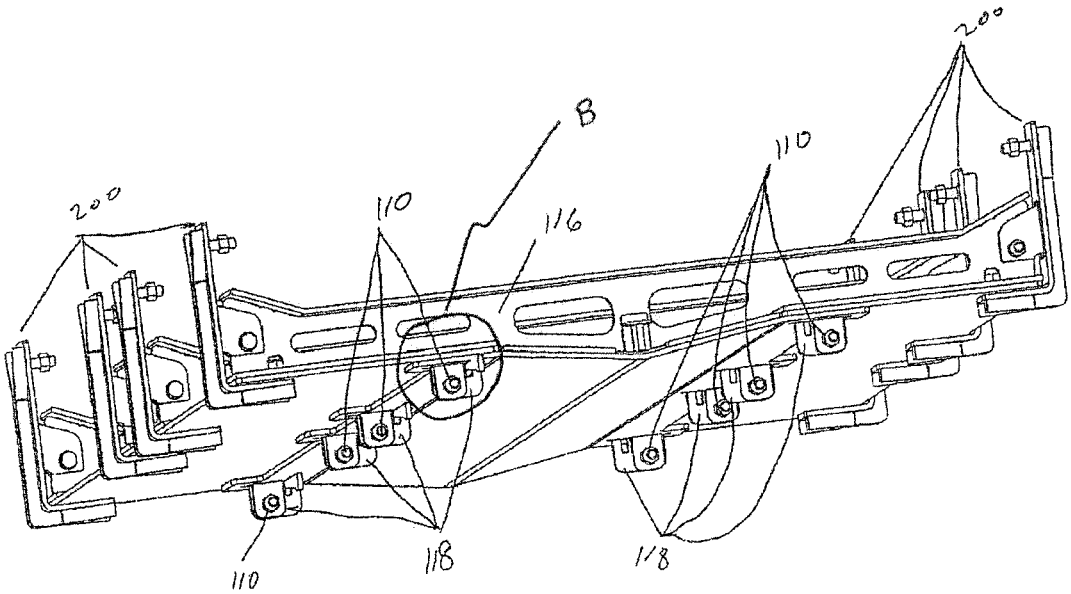
Figure 9A:
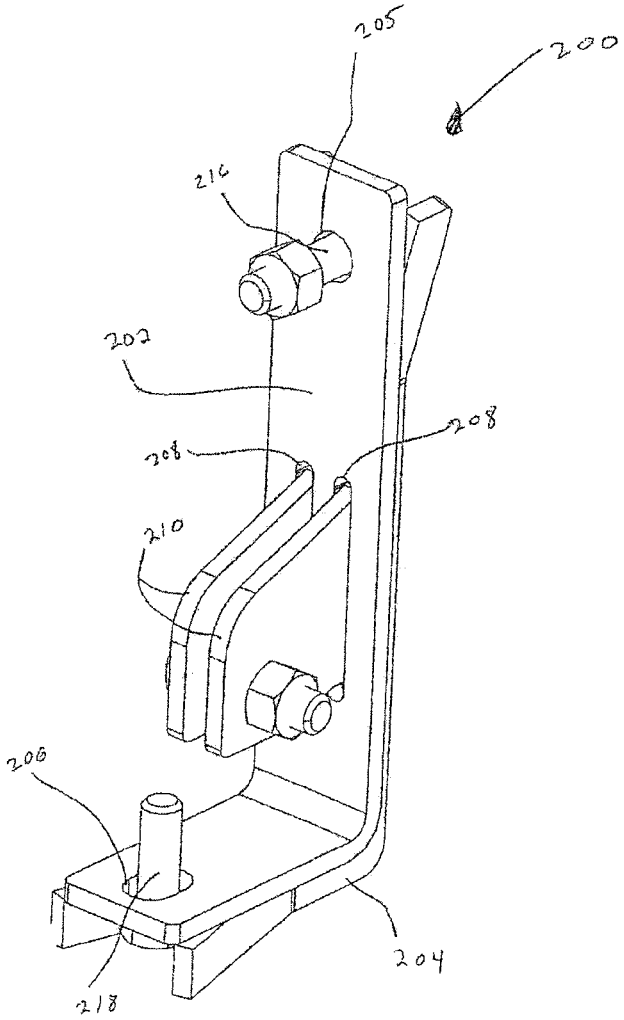
FIGS. 9A and 9B are perspective views of a sidewall attachment device.
Figure 9B:
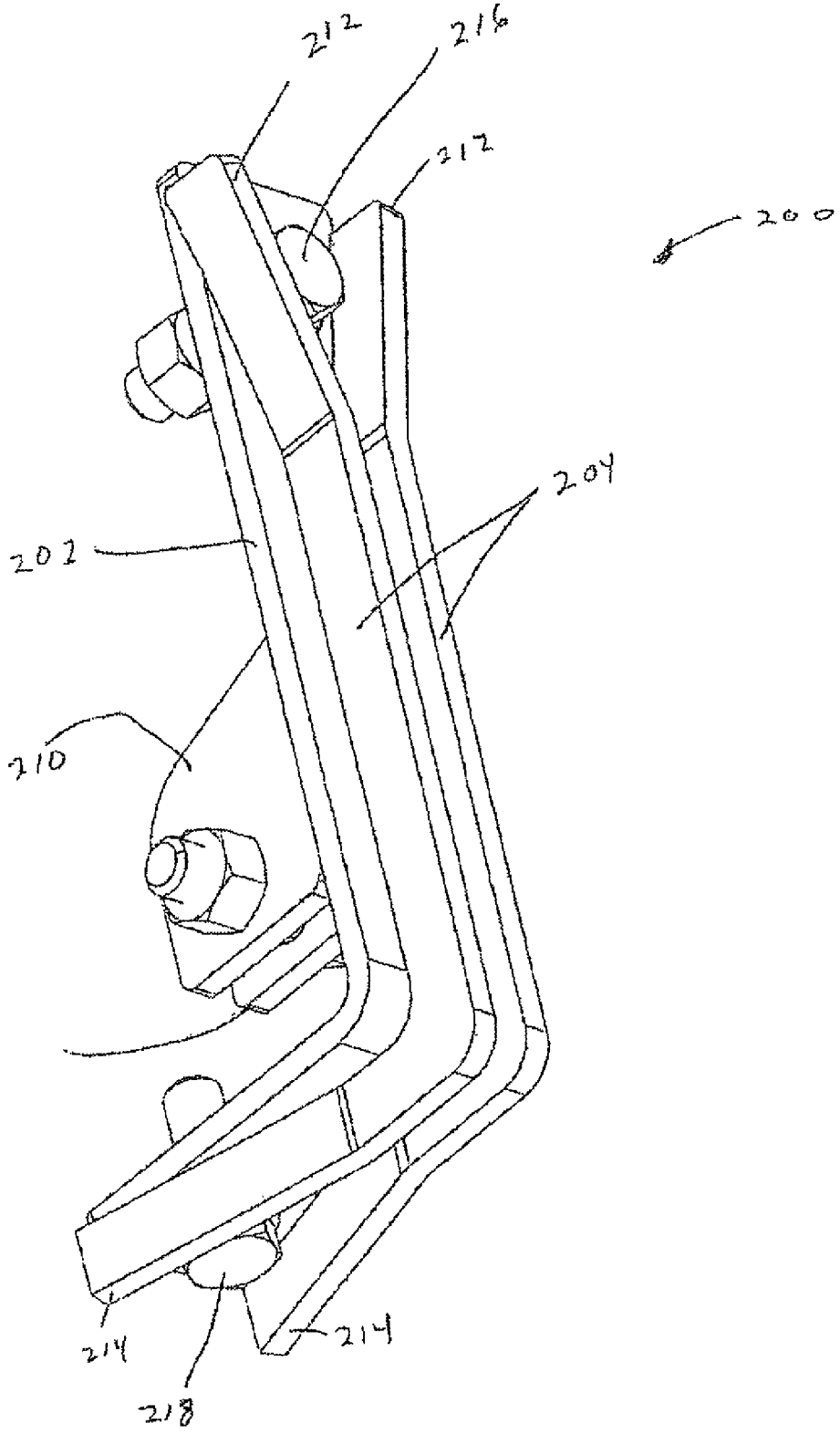

In addition, a sidewall attachment device, generally indicated at 200 in FIG. 5B, may be provided. The sidewall attachment device 200 is configured to facilitate mating of a sidewall (not illustrated) with the rib and underbelly 117. As such, and as illustrated in FIG. 9, it comprises an angle bracket 202, and two rib-support members 204. The rib-support members 204 are formed so that they are aligned generally perpendicularly to the surface of the angle bracket 202.

The angle bracket 202 comprises a round through going apertures 205, a slightly elongate through going aperture 206, and two slots 208. The rib-support members 204 each comprise wings 210 designed to be received within the slots 208 of the angle bracket 202. In addition, the ends 212, 214 of each one are angled outwardly, so as to accommodate a bolt 216, 218, or any other similar coupling arrangement.

In use, the sidewall is attached to the angle bracket 202 by securing a bolt 216 to it. The wings 210 of the rib-support members 204 are attached to the ribs, and the underbelly 117 is attached to the angle-bracket 202 by a bolt 218. In this way, the sidewall, rib, and underbelly can be easily assembled to one another.

As seen, e.g., in FIG. 5A, the rib 116 may be formed with a notch 220 to accommodate a nut 222 which secures the bolt 218. This notch 220 may be useful as well to prevent the nut 222 from rotating when being secured to the bolt.

Those skilled in the art to which this invention pertains will readily appreciate that numerous changes, variations and modifications can be made without departing from the scope of the invention mutatis mutandis.

The invention claimed is:

1. A coupling arrangement between the following two vehicle components: a reinforcing rib component and an underbelly component of a vehicle, the coupling arrangement comprising:

a tooth projecting from a first of the two vehicle components through a second of the two vehicle components;

an aperture formed in a second of the two vehicle components and receiving therethrough the tooth; and one or more coupling elements attached to the tooth and bearing against the second of the two vehicle components;

the tooth being configured for urging the one or more coupling elements toward the second of the two vehicle components, thereby increasing contact pressure between the two vehicle components, wherein the tooth includes an elongated aperture extending substantially in a direction in which the tooth projects, the tooth being configured to receive a tensioning element that facilitates positioning of the one or more coupling elements on the tooth.

2. The coupling arrangement according to claim 1, wherein the tensioning element includes a wedge having a narrow leading edge at a first end and gradually increasing in size along a length of the wedge toward a second end.

3. The coupling arrangement according to claim 2, wherein the tensioning element further includes a stopper adjacent the second end thereof being configured for preventing ejection of the tensioning element through the elongated aperture in a direction toward the first end.

4. The coupling arrangement according to claim 1, wherein each of the coupling elements includes a through-going aperture configured for securing thereof to the tooth, and a surface configured for bearing upon the second component.

5. The coupling arrangement according to claim 1, wherein the first vehicle component is the reinforcing rib, and the second vehicle component is the underbelly.

6. An armored vehicle comprising the coupling arrangement according to claim 1.

7. A method for increasing contact pressure between the following two armored vehicle components: a reinforcing rib component and an underbelly component during assembly thereof, the method comprising:

providing the two components, a first of the two components having a tooth projecting therefrom, and a second of the two components including an aperture configured to receive therein the tooth;

providing one or more coupling elements configured for attachment to the tooth;

providing a tensioning element designed to facilitate attachment of the one or more coupling elements on the tooth;

inserting the tooth through the aperture; and utilizing the tensioning element to attach the one or more coupling elements such that the tooth urges the one or more coupling elements toward the second component, thereby increasing contact pressure between the two components, wherein the tooth includes an elongated aperture extending substantially in a direction in which the tooth projects, the tensioning element being configured to be at least partially received therewithin.

8. The method according to claim 7, wherein the tensioning element includes a wedge having a narrow leading edge at a first end and gradually increasing in size along a length of the wedge toward a second end.

9. The method according to claim 8, wherein the tensioning element further includes a stopper adjacent the second end thereof being configured for preventing ejection of the tensioning element through the elongated aperture in a direction toward the first end.

10. The method according to claim 7, wherein each of the one or more coupling elements includes:

a through-going aperture configured for facilitating securing thereof to the tooth, and a surface configured for bearing upon the second component.

11. The method according to claim 7, wherein the first component is the reinforcing rib, and the second component is the underbelly.

12. The coupling arrangement according to claim 1, wherein each of the one or more coupling elements includes:

a tensioning element having a slot configured to receive therein the tooth, and an aperture passing through the slot, the tensioning element being configured to pull the tooth through the coupling element.

13. The coupling arrangement according to claim 12, wherein the aperture is formed to be in alignment with a corresponding aperture formed in the rib.

14. The coupling arrangement according to claim 12, wherein the aperture is elongate.

15. The coupling arrangement according to claim 12, wherein the aperture is formed substantially perpendicularly to the slot.

16. The coupling arrangement according to claim 12, wherein the one or more coupling elements further include an internally threaded aperture, formed generally parallel to and on a first side of the slot, and a bolt configured to be threaded therethrough.

17. The coupling arrangement according to claim 16, wherein the one or more coupling elements further include a rounded edge being formed on a second side, being opposite the first side, of the slot.

18. The method according to claim 7, wherein the tensioning element includes:

a slot configured to receive therein the tooth, and an aperture passing through the slot, the tensioning element being configured to pull the tooth through the coupling element.

19. The method according to claim 18, wherein the aperture is formed to be in alignment with a corresponding aperture formed in the rib.

20. The method according to claim 18, wherein the aperture is elongate.

21. The method according to claim 18, wherein the aperture is formed substantially perpendicularly to the slot.

22. The method according to claim 18, wherein the coupling element further includes:

an internally threaded aperture, formed generally parallel to and on a first side of the slot, and a bolt configured to be threaded therethrough, and the method further includes threading the bolt through the internally threaded aperture such that the internally threaded aperture bears against the coupling element.

23. The method according to claim 22, wherein the coupling element further includes a rounded edge being formed on a second side, being opposite the first side, of the slot.

* * * * *